US009669845B2

(12) United States Patent
Selapack et al.

(10) Patent No.: US 9,669,845 B2
(45) Date of Patent: Jun. 6, 2017

(54) OPEN TOP HOPPER RAILCAR WITH LADING SHEDDING TOP CHORD AND CORNER CAP AND INTEGRATED DOOR OPERATING CONTROLS WITH MANUAL OVERRIDE

(71) Applicant: FreightCar America, Inc., Johnstown, PA (US)

(72) Inventors: Michael A Selapack, Portage, PA (US); Christopher S Wissinger, New Paris, PA (US); Todd L Lydic, Johnstown, PA (US)

(73) Assignee: JAC OPERATIONS, INC., Chicago, IL (US)

( * ) Notice: Subject to any disclaimer, the term of this patent is extended or adjusted under 35 U.S.C. 154(b) by 687 days.

(21) Appl. No.: 13/692,090

(22) Filed: Dec. 3, 2012

(65) Prior Publication Data

US 2013/0160670 A1 Jun. 27, 2013

Related U.S. Application Data

(63) Continuation of application No. 12/715,077, filed on Mar. 1, 2010, now Pat. No. 8,342,105.

(60) Provisional application No. 61/297,888, filed on Jan. 25, 2010.

(51) Int. Cl.

| | |
|---|---|
| ***B61D 7/02*** | (2006.01) |
| ***B61D 7/00*** | (2006.01) |
| ***B61D 7/28*** | (2006.01) |

(52) U.S. Cl.

CPC ..... *B61D 7/02* (2013.01); *B61D 7/00* (2013.01); *B61D 7/28* (2013.01)

(58) Field of Classification Search

USPC ..... 105/406.1, 406.2, 409, 410, 411, 404, 105/311.1, 287, 288, 244, 245, 246, 247, 105/248, 280, 284, 286, 296; 296/32

See application file for complete search history.

(56) References Cited

U.S. PATENT DOCUMENTS

| | | | |
|---|---|---|---|
| 144,966 | A | 11/1873 | Elliott et al. |
| 147,341 | A | 2/1874 | Meyer |
| 162,189 | A | 4/1875 | Pierce |
| 217,289 | A | 7/1879 | Kane |
| 347,523 | A | 8/1886 | Scully |
| 349,134 | A | 9/1886 | Barr |
| 369,102 | A | 8/1887 | Davis |

(Continued)

*Primary Examiner* — Mark Le

(74) *Attorney, Agent, or Firm* — Blynn L. Shideler; Krisanne Shideler; BLK Law Group

(57) ABSTRACT

A open top railcar comprises a railcar body supported on the spaced trucks, the body comprising side and end structures on the railcar, and a top chord extending the length of the side structures and the width of the end structures, wherein the top chord includes an inwardly sloped top surface for discharging lading toward the railcar interior. The railcar may further include corner cap, or end cap members, including inwardly sloped lading discharging top surfaces. The railcar may be a hopper railcar having discharge chutes forming body pockets opening into the interior with pneumatic doors having manual override for each door. The railcar may include a nonmetallic touch pad housing secured to the side structures and including a plurality of touch plates mounted in the housing configured for operating selective individual doors and combination of doors.

18 Claims, 7 Drawing Sheets

(56) References Cited

U.S. PATENT DOCUMENTS

| | | | | | |
|---|---|---|---|---|---|
| 500,846 | A | | 7/1893 | Blackstone | |
| 528,279 | A | | 10/1894 | Roberts | |
| 568,775 | A | | 10/1896 | Lane | |
| 658,783 | A | | 10/1900 | King | |
| 699,820 | A | | 5/1902 | Sage | |
| 743,501 | A | | 11/1903 | Hansen | |
| 763,186 | A | | 6/1904 | Johnson | |
| 779,627 | A | | 1/1905 | Smith | |
| 797,341 | A | | 8/1905 | Brown | |
| 881,884 | A | | 3/1908 | Dodds | |
| 891,325 | A | | 6/1908 | Butchart | |
| 914,242 | A | | 3/1909 | Campbell | |
| 937,419 | A | | 10/1909 | Campbell | |
| 1,182,642 | A | | 5/1916 | Clark | |
| 1,300,959 | A | | 4/1919 | Hart | |
| 1,418,907 | A | | 6/1922 | Campbell | |
| 1,444,730 | A | | 2/1923 | Christianson | |
| 2,079,862 | A | | 5/1937 | Kiesel, Jr. | |
| 3,080,829 | A | | 3/1963 | Damy | |
| 3,104,623 | A | * | 9/1963 | Dorey | 105/248 |
| 3,187,684 | A | | 6/1965 | Ortner | |
| 3,242,878 | A | | 3/1966 | Floehr | |
| 3,256,836 | A | | 6/1966 | Floehr | |
| 3,348,501 | A | | 10/1967 | Stevens et al. | |
| 3,509,827 | A | | 5/1970 | Sutter | |
| 3,577,932 | A | | 5/1971 | Pulcrano et al. | |
| 3,772,997 | A | * | 11/1973 | Heap et al. | 105/406.1 |
| 4,228,742 | A | | 10/1980 | Przybylinski et al. | |
| 4,292,898 | A | | 10/1981 | Gordon et al. | |
| 4,361,096 | A | | 11/1982 | Funk | |
| 4,644,871 | A | | 2/1987 | Arrey et al. | |
| 4,840,127 | A | | 6/1989 | Tomaka | |
| 4,884,511 | A | | 12/1989 | Hallam et al. | |
| 5,070,793 | A | * | 12/1991 | Kurtz et al. | 105/406.1 |
| 5,123,801 | A | * | 6/1992 | O'Daniel | 414/525.1 |
| 5,249,531 | A | | 10/1993 | Taylor | |
| 5,335,603 | A | | 8/1994 | Wirick et al. | |
| 5,417,165 | A | | 5/1995 | Peppin et al. | |
| 5,584,252 | A | | 12/1996 | Smith et al. | |
| 5,934,200 | A | | 8/1999 | Lydic | |
| 6,302,031 | B1 | | 10/2001 | Smith et al. | |
| 6,334,397 | B1 | | 1/2002 | Valgora | |
| 6,405,658 | B1 | | 6/2002 | Taylor | |
| 6,601,522 | B2 | | 8/2003 | Roxby | |
| 6,955,127 | B2 | | 10/2005 | Taylor | |
| 7,080,599 | B2 | | 7/2006 | Taylor | |
| 2006/0254456 | A1 | | 11/2006 | Taylor | |
| 2007/0101895 | A1 | | 5/2007 | Forbes et al. | |
| 2007/0101896 | A1 | | 5/2007 | Forbes et al. | |
| 2007/0245923 | A1 | | 10/2007 | Galvan | |
| 2008/0066642 | A1 | | 3/2008 | Forbes et al. | |
| 2009/0007813 | A1 | | 1/2009 | Early | |

* cited by examiner

FRONT VIEW

EXPLODED VIEW

OPEN TOP HOPPER RAILCAR WITH LADING SHEDDING TOP CHORD AND CORNER CAP AND INTEGRATED DOOR OPERATING CONTROLS WITH MANUAL OVERRIDE

RELATED APPLICATION

The present application is a continuation of U.S. patent application Ser. No. 12/715,077 filed Mar. 1, 2010 and which issued as U.S. Pat. No. 8,342,105. U.S. patent application Ser. No. 12/715,077 claims the benefit of U.S. Provisional Patent Application Ser. No. 61/297,888 entitled "Open Top Hopper Railcar with Lading Shedding Top Chord and Corner Cap and Door Operating Controls with Manual Override." Filed Jan. 25, 2010.

BACKGROUND OF THE INVENTION

1. Field of the Invention

The present invention relates to a railroad hopper cars, and more particularly to the top chord corner cap and door structures for an open top hopper railcar.

2. Background Information

A hopper railcar, or hopper car, is a railcar used to transport loose bulk commodities such as grain, coal, minerals, fertilizers, cement, etc. The hopper car interior is typically divided into pockets or hoppers with doors on the bottom of each pocket to empty cargo by the force of gravity, making for quick and effective unloading. The discharge doors do not prevent the use of a rotary unloader that pivots the entire car, but the discharge doors on the bottom do not require the use of such a rotary unloader.

Further the hopper railcars may be closed hopper railcars or open top railcars that are easy for top loading. Even with "open top" hopper railcars, removable covers can be used for transport and other specialized tops could be used with a hopper railcar depending upon the intended cargo.

Closed railway hopper cars with pneumatic systems for unloading are often used for the transportation of powdered and granular products. For cars with positive pressure pneumatic systems, air may be supplied from an external source to pressurize the interior of the car body and simultaneously fluidize the dry, bulk product carried within the car to enable it to be conveyed in a fluidized state through product transfer conduits from the car to a collection facility. Air pressure within the hopper car during unloading is typically maintained at approximately fifteen pounds per square inch gauge pressure.

The present invention is primarily related to open top hopper cars, but certain aspects of the invention may be used in other car types, such as in an open top gondola car. The following is a brief discussion to establish the state of the art in open top hopper railcar and door operating systems, with the following patents grouped largely into time blocks related to time of issuance.

U.S. Pat. Nos. 144,966; 147,341, 162,189; 217,289; 347, 523; 349,134, 369,102; 500,846; 528,279; and 568,775 which issued between 1873-1889 disclose early proposed hopper railcar designs, which is helpful to illustrate the basic hopper concepts and to better demonstrate hopper car evolution.

U.S. Pat. No. 658,783, issued shortly after the turn of the last century, discloses early hopper car construction with the body formed of metal sheets coupled together. In a similar time frame, U.S. Pat. No. 699,820 discloses a general hopper car and specifically a door operating mechanism for a hopper car, also called a "dumping car" therein. U.S. Pat. No. 743,501 discloses a hopper car and specifically an ore carrying car design. U.S. Pat. No. 763,186 discloses a general hopper car and specifically a door operating mechanism for a hopper car, also called a "dumping car" therein. U.S. Pat. No. 797,341 discloses a reinforced central hopper type hopper car. U.S. Pat. No. 881,884 discloses a general hopper car and specifically a door operating mechanism for a hopper car, also called a "dumping car" therein. U.S. Pat. No. 891,325 discloses a general hopper car and specifically a hopper lining for an ore car. U.S. Pat. No. 914,242 discloses a general hopper car also called a "dump car" therein. U.S. Pat. No. 937,419 discloses a general hopper car also called a "dump car" therein.

U.S. Pat. No. 1,182,642 discloses a general hopper car also called a "dump car" therein. U.S. Pat. No. 1,300,959 discloses a general hopper car also called a "hopper dump car" therein, which shows multiple hoppers and distinct transverse doors for the individual hoppers, that is most common today. U.S. Pat. No. 1,418,907 discloses a general hopper car and specifically a door operating mechanism for a hopper car, also called a "dump car" therein. U.S. Pat. No. 1,444,730 discloses a general hopper car and specifically a door operating mechanism for a hopper car, also called a "hopper bottom" therein.

U.S. Pat. No. 2,079,862 discloses a general hopper car and specifically a particular center-sill design for use therein.

U.S. Pat. No. 3,080,829 discloses a ballast hopper car and specifically a ballast distributing hopper car. U.S. Pat. No. 3,104,623 discloses a general hopper car and specifically a door locking structure for a hopper railcar. U.S. Pat. No. 3,187,684 discloses a general hopper car and specifically a door opening system for a hopper railcar. U.S. Pat. No. 3,242,878 discloses a "shallow" hopper car design. U.S. Pat. No. 3,256,836 discloses a general hopper car and specifically a door opening system for a hopper railcar. U.S. Pat. No. 3,348,501 discloses a general hopper car and specifically a sliding door opening system for a hopper railcar. U.S. Pat. No. 3,509,827 discloses an aluminum body hopper car. U.S. Pat. No. 3,577,932 discloses a hopper car and specifically a door opening system for a hopper railcar.

U.S. Pat. No. 4,228,742 discloses a hopper car, also called a "vehicle hopper" therein, having longitudinally spaced hopper end slope sheets and hopper cross ridge slope sheets formed prior to assembly. U.S. Pat. No. 4,292,898 discloses a hopper car including an elongated, load bearing body having walls formed of a specified fiber reinforced plastic resin composite of glass reinforcing filaments and a structural "organo-polymeric" resin. U.S. Pat. No. 4,361,096 discloses a hopper car including seals to prevent seepage of a fine granular commodity between the hopper doors and the adjacent hopper sheets of a railroad hopper car of the type having opposed pairs of hopper doors swingable between a closed position and a downwardly depending open position. The seals comprise elongated strips of flexible material with their upper longitudinal edge portions mounted along the inside lower edges of the inner and outer hopper sheets and being of a width such that their free lower longitudinal edge portions extend downwardly beyond the lower edges of the hopper sheets. The free edge portions of the seals being bent inwardly by and lying in sealing engagement against the hopper doors when the hopper doors are in their closed position. Similar strips of flexible material may be so located as to form a seal between the upper portion of each hopper door and its adjacent slope sheet. U.S. Pat. No. 4,366,757 discloses a hopper railcar apparatus for actuating and locking each pair of hopper doors of a railroad hopper car of the type having a plurality of hopper doors arranged in opposed pairs and extending transversely of the hopper car center sill. U.S. Pat. No. 4,644,871 discloses an articulated hopper railcar with a designated "short distance" between truck centers. The railcar features two bodies supported by a center truck and two end trucks, wherein the center truck takes somewhat more loading than the other two end trucks. U.S. Pat. No. 4,840,127 discloses a top chord structure for a hopper car. U.S. Pat. No. 4,884,511 discloses an aluminum body hopper railcar with having a center sill hood which uses aluminum collar castings.

U.S. Pat. No. 5,070,793 discloses a top chord structure for a gondola car that is relevant here for the discussion of the top chord. U.S. Pat. No. 5,249,531 discloses actuating system for operating the doors of a railroad hopper car. A plurality of levers for each hopper operate to rotate the doors of the hopper between an open and a closed position and also provides an over center latch to positively close each door. U.S. Pat. No. 5,417,165 discloses a railroad hopper ballast discharge door assembly includes pliant side panels along a discharge gate opening. The pliant side panels are strong enough to retain the ballast within the hopper when the door is closed, yet are flexible enough to yield when ballast flowing out of the hopper becomes wedged between the side panel and the door as the door closes. U.S. Pat. No. 5,335,603 discloses a top chord structure for a gondola car that is relevant here for the discussion of the top chord. U.S. Pat. No. 5,584,252 discloses a general hopper railcar. The assignees prior U.S. Pat. No. 5,934,200 discloses a lightweight hopper-type rail car designed to minimize aerodynamic drag and including a cross ridge arrangement to increase the fabrication efficiency of the car.

U.S. Pat. No. 6,334,397 discloses side sheet construction for a hopper railcar, also called a bulk container car, side sheet assembly for a rail car having a pair of horizontally extending upper and lower side sheets form with a plurality of longitudinally extending strengthening ribs. The upper and lower side sheets are affixed to each other at a horizontal seam to either form flat connection or a rib at the horizontal seam. U.S. Pat. No. 6,302,031 discloses a top chord and side wall structure for a hopper car. U.S. Pat. No. 6,405,658 discloses a manual discharge door operating system for a hopper railcar which is provided with an over-center closed position to hold the door in the closed position. U.S. Pat. No. 6,601,522 discloses an open top hopper car with a top chord designed to improve loading characteristics. U.S. Pat. No. 6,955,127 discloses actuating system for manually operating the doors of a railroad hopper car.

U.S. Pat. No. 7,080,599 discloses an actuating system for operating transverse doors of a railroad hopper car which close in an over center position. The mechanism includes an operating member which is coupled to a door or doors of the car by a shaft and a linkage which couples a power source to the operating member, where the operating member rotates to move the door away from the hopper. The mechanism can operate doors which open in opposed direction with a single power source. The mechanism can be used in new car construction, and can be retrofitted onto existing hopper cars.

U.S. Patent Publication 2006/0254456 discloses a general hopper railcar and a transverse door operating system with an over-center door locking or closed position. U.S. Patent Publications 2007/0101895 and 2007/0101896 disclose general hopper railcar structures.

U. S. Patent Publication 2008/0066642 discloses a general hopper railcar with seal member or seal member assembly that is mounted to one or both of the closure members. When open, the seal member or seal member assembly lies substantially flush with, or shy of, the slope of the surface of the closure member. When closed, the seal member may be self-energizing, in the sense that as lading is added the seal may tend to seal more tightly. The seal assembly may include a cantilevered spring that presents a land to the opposed closure member, and a fulcrum, over, or across, which the spring is cantilevered, such that pushing down on one end of the spring may tend to cause the other end to flex upward. The fulcrum may also be cantilevered outward from the slope sheet of the closure member to which the seal assembly is attached. The discharge section may be robustly reinforced to discourage deformation.

U.S. Patent Publication 2009/0007813 discloses a general hopper railcar with opposed double doors for discharging cargo from a hopper car.

The prior art has provided a variety of open top hopper railroad cars. The above listed patents and published patent applications are representative of the state of the art of hopper railcars and these patents and published applications are incorporated by reference herein in their entireties. There remains a need for simple top chord structures that assist in loading and unloading the lading. Further there is a need to provide for simple efficient door operation.

SUMMARY OF THE INVENTION

It is an object of the present invention to provide an open top hopper railcar with lading shedding top chord and corner cap and door operating controls with manual override.

One embodiment of the present invention provides a railroad open top hopper car comprises a pair of spaced trucks; and a railcar body supported on the trucks, the body comprising a pair of side structures on opposed sides of the railcar and a pair of end structures on opposed ends of the railcar, and a top chord extending the length of the side structures and the width of the end structures, wherein the top chord includes an inwardly sloped top surface configured to discharge lading toward the interior of the railcar through gravity.

According to one aspect of the invention the railcar further includes corner cap members, with each corner cap including inwardly sloped top surface configured to discharge lading toward the interior of the railcar through gravity.

According to one aspect of the invention the railcar is a hopper railcar having a plurality of discharge chutes forming pockets for the body which open to the interior with a plurality of door operated through a pneumatic door operating system and further including a manual door operating override for each door. Further the invention may include rotary shafts extending to each side walls with each rotary shaft including a mechanical coupling at a distal end thereof configured to receive a manual rotation member therein. According to one aspect of the invention the railcar is a hopper railcar having a plurality of discharge chutes forming pockets for the body which open to the interior with a plurality of door operated through an automated door operating system and a nonmetallic touch pad housing secured to the side structures and including a plurality of touch plates mounted in the housing configured for operating selective doors. Further the invention may include a touch-plate associated with each door for operating each door individually and a further touch-plate configured to operate all of the doors simultaneously.

In one non-limiting aspect of the invention the top chord that includes an inwardly sloped top surface configured to discharge lading toward the interior of the railcar through gravity, is formed as a closed extruded section. Further, the top chord may include a inside stake attaching web, a lower surface having a width equal to at least a width of the side structure, a vertical outer surface extending from the lower surface to the top surface, and an inner surface extending from the top surface to the inside stake attaching web. Additionally the inner surface of the top chord may include an offset whereby the top surface has a greater horizontal width than the horizontal width of the lower surface.

In one non-limiting embodiment of the invention the corner cap, or end cap members that have inwardly sloped top surface configured to discharge lading toward the interior of the railcar through gravity further include a vertical extending lip at a distal end of the top surface of the end cap.

These and other advantages of the present invention will be clarified in the brief description of the preferred embodiment taken together with the drawings in which like reference numerals represent like elements throughout.

DESCRIPTION OF THE PREFERRED EMBODIMENTS

Figure 1A:
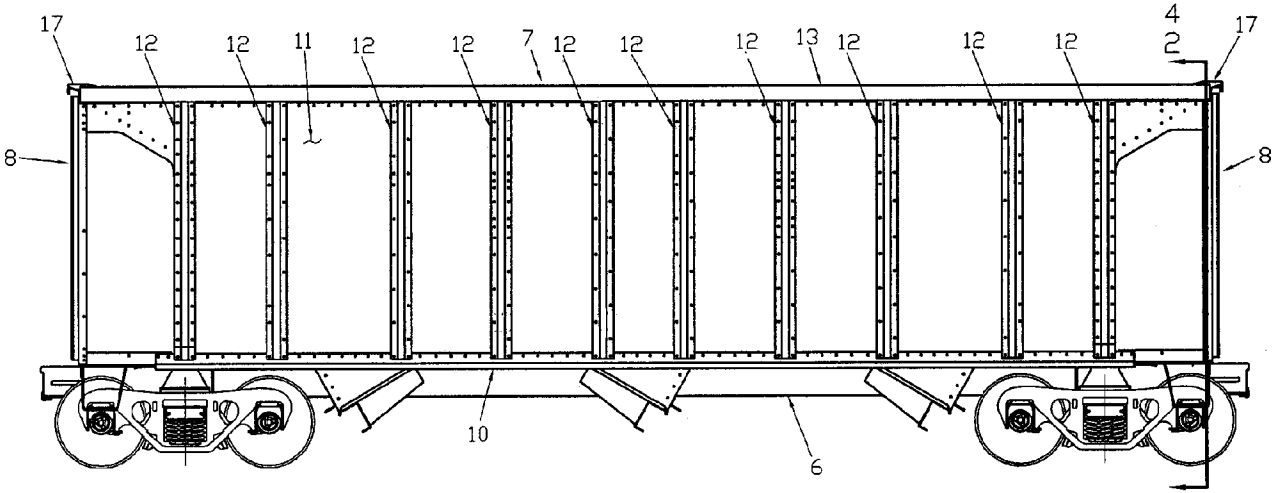
FIG. 1A is a side elevation view of a pair of an open top hopper railcar in accordance with one aspect of the present invention.
Figure 1B:
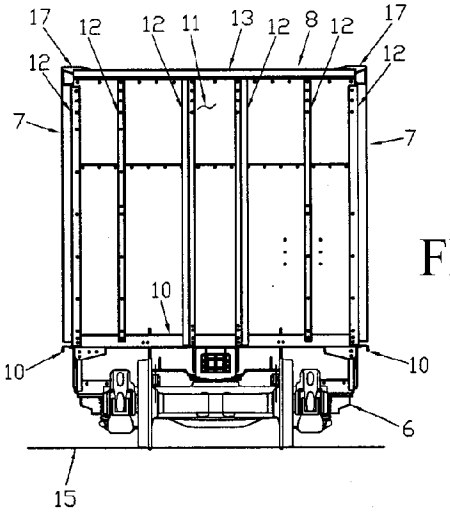
FIG. 1B is an end elevation view of the railcar of FIG. 1A.

The present invention provides an open top hopper railcar 6 with lading shedding top chord 13 and corner cap, or end cap 17 and door operating controls with manual override as will be described hereinafter. It will be apparent that various features of the present invention, such as the lading shedding top chord 13 and corner ca corner caps, or end caps 17 can easily be implemented in other car types, such as gondola cars.

Each railcar 6 includes a number of conventional features that need not be described herein in detail as they are well known in the art, including an under-frame structure, including a center sill, formed on a pair of spaced trucks and couplers for connecting adjacent cars. These conventional elements can be formed in a variety of known methods. For example the Assignee's proprietary one-piece cold formed center sill provides numerous advantages for forming the center sill structure of the car, but other known center sill designs can be utilized.

Additionally a typical hopper car body of the railcar 6 includes two spaced side wall structures 7 and two spaced end wall structures 8 forming the open box shape for the car within which the lading 9 is carried for transport and delivery. Each side wall 7 conventionally includes a lower side sill 10 and an upper top chord 13 with side stakes 12 extending there between. Side plates 11 complete the side wall structure. Analogously, the end walls 8 includes a lower end sill 10 and an upper top end chord 13 with stakes 12 extending there between, and plates 11 complete the end wall structure. Corner caps, or end caps 17 connect the top chords 13 of the side wall and the end wall 8. These structures are convention, other than the lading shedding corner cap, or end cap 17 and the lading shedding top chord 13 of the present invention as described hereinafter.

Figures 2A, 3A, 4A, 5A:
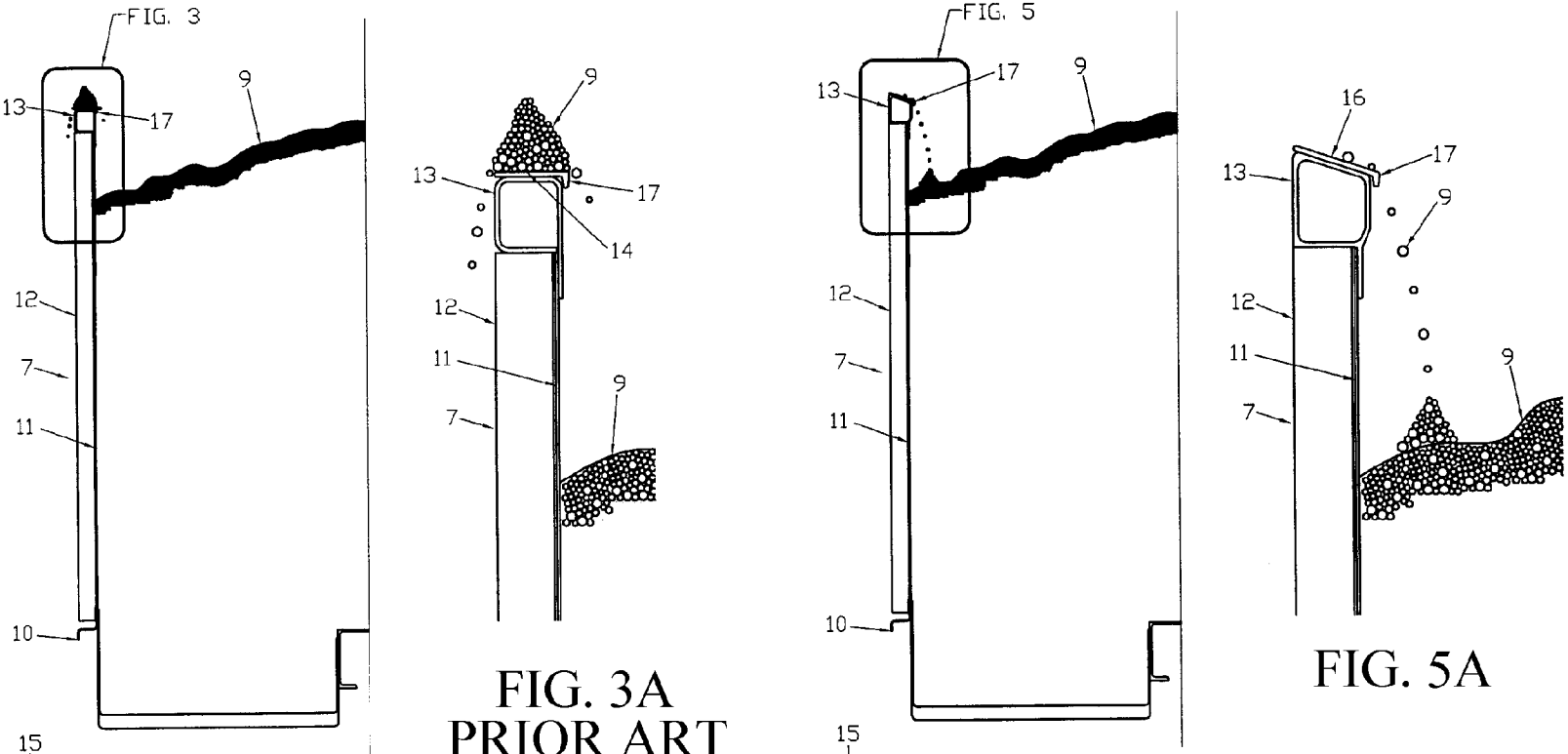
FIG. 3A PRIOR ART
FIG. 2A PRIOR ART
FIG. 2A is a section elevation view of a side wall structure of a conventional hopper railcar including a corner cap, or end cap member according to the prior art.
FIG. 3A is an enlarged section elevation view of the prior art corner cap, or end cap member of FIG. 2A.
FIG. 4A is a section elevation view of a side wall structure of an open top hopper railcar including a corner cap, or end cap member according to one aspect of the present invention.
FIG. 5A is an enlarged section elevation view of the corner cap, or end cap member of FIG. 4A.
Figure 3B:
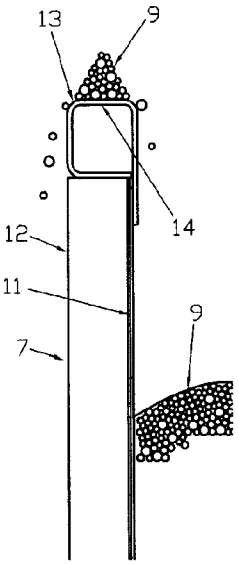
FIG. 3B PRIOR ART
FIG. 3B is an enlarged section elevation view of the prior art top chord member of FIG. 2B.
Figure 2B:
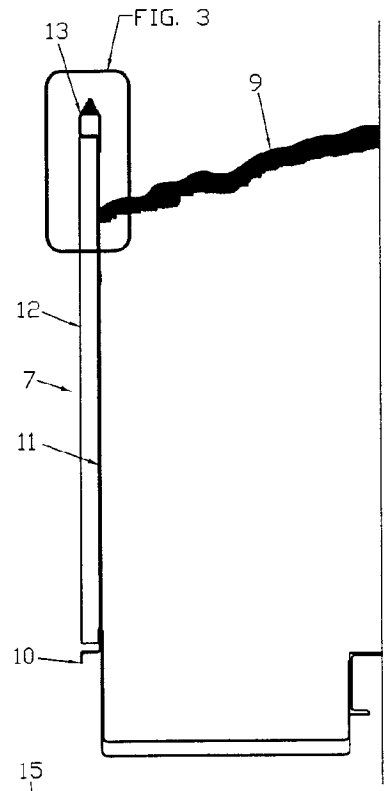
FIG. 2B PRIOR ART
FIG. 2B is a section elevation view of a side wall structure of a conventional hopper railcar according to the prior art.

The lading shedding corner cap, or end cap 17 and the lading shedding top chord 13 of the present invention may be best illustrated with a review of the prior art structures shown in FIGS. 2-3. As is illustrated in these figures the top surface 14 of the prior art corner caps, or end caps 17 and the top surface 14 of the prior art corner caps 13 is formed horizontally. This structure will accommodate lading 9 during loading as illustrated. The lading 9 is then manually removed with mechanical sweeping type devices or pneumatic blasting cleaners or hydraulic blasting cleaners. The hydraulic blasting cleaners will add a further detriment of adding water to the lading. Consequently this horizontal structure requires additional equipment and/or manual attention and still results in lading being lost to the ground, either during cleaning and/or travel.

Figure 5B:
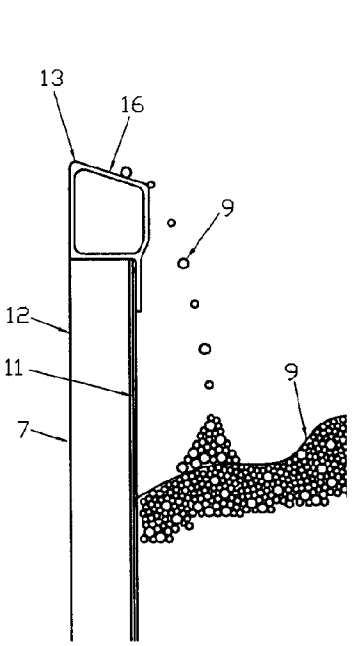
FIG. 5B is an enlarged section elevation view of the top chord member of FIG. 4B.
Figure 4B:
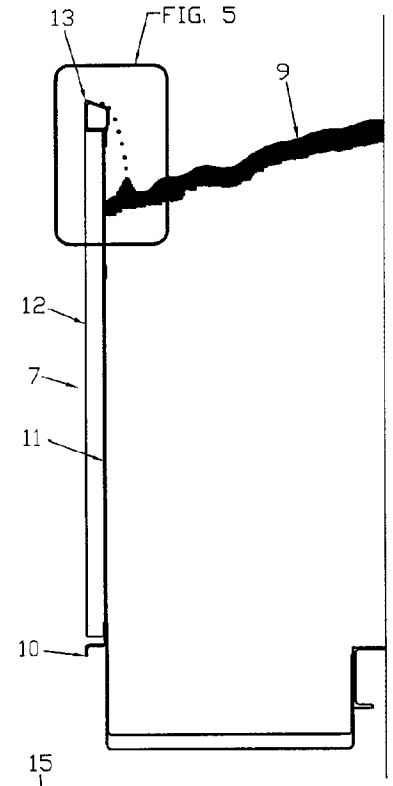
FIG. 4B is a section elevation view of a side wall structure of an open top hopper railcar including a corner cap, or end cap member according to one aspect of the present invention.

The railcar 6 of the present invention include a lading shedding side corner cap 17 and lading shedding top chord 13, each of which includes a top surface 16 angled toward the interior of the railcar 6. The top chord 13 and corner cap 17 is lading shedding as each profile has a top surface 16 angled toward the interior of the hopper car 6 so that lading will be directed by gravity toward the interior of the hopper as can be seen in FIGS. 4-5, eliminating spills of lading 9 onto the ground 15. Additionally the attachment web of the top chord 13 will be spaced from the outside edge of the top chord 13 by the approximate depth of the side stakes 12 as shown in FIG. 4B. The top chord 13 may be a closed section aluminum extrusion as shown. Open section shapes are also possible but the closed section offers some structural advantages.

The lading shedding top chord 13 and corner cap 17 structure of the side and end structures 7 and 8 of the railcar 6 as shown and described is well suited for applications in other open top car types, most notably for gondola type cars. Gondola type cars typically do not have bottom discharge chutes, but rather include additional lading storage space in tubs on either side of the center sill, with the tub shapes being what has generated the gondola name.

The side structure of the railcar 6 of the present invention could be used in other side wall designs, such as in an inside stake car. An inside stake configuration for the railcar 6 would simply require changing the location of the attaching webs for the top chord 13 and bottom side sill 10, and reversing the orientation of the side stakes 12 and position of sheets 11. The inside stake position may alter some cross bracing locations as well.

The car bottom forms a plurality of discharge chutes which open to the interior with a plurality of doors as is well known in the art. Each door or pair of doors is operated by a pneumatic door operating mechanism. The details of the pneumatic door operating mechanism are not discussed herein in detail and a variety of pneumatic operating systems can be used as referenced above in the background of the invention patents which describe a number of acceptable pneumatic door operating systems. The present invention is directed only to an emergency manual override and a universal control pad for the operation and control of such door operating system.

Presently pneumatic doors have no safe way to open the bottom doors if the pneumatic system fails, generally when the air cylinder loses its charge. The current solution for this issue is to bring a portable pressurizing source to re-pressurize the system and open the doors. Where re-pressurization (either of the air tank or the respective lines, bypassing the air tank) is unavailable or impractical, the alternative solution is to disconnect the door linkages and then force the doors open. This alternative solution is a dangerous approach as the linkages are not always easily accessible and places workers under the car in dangerous and awkward positions.

Figure 6A:
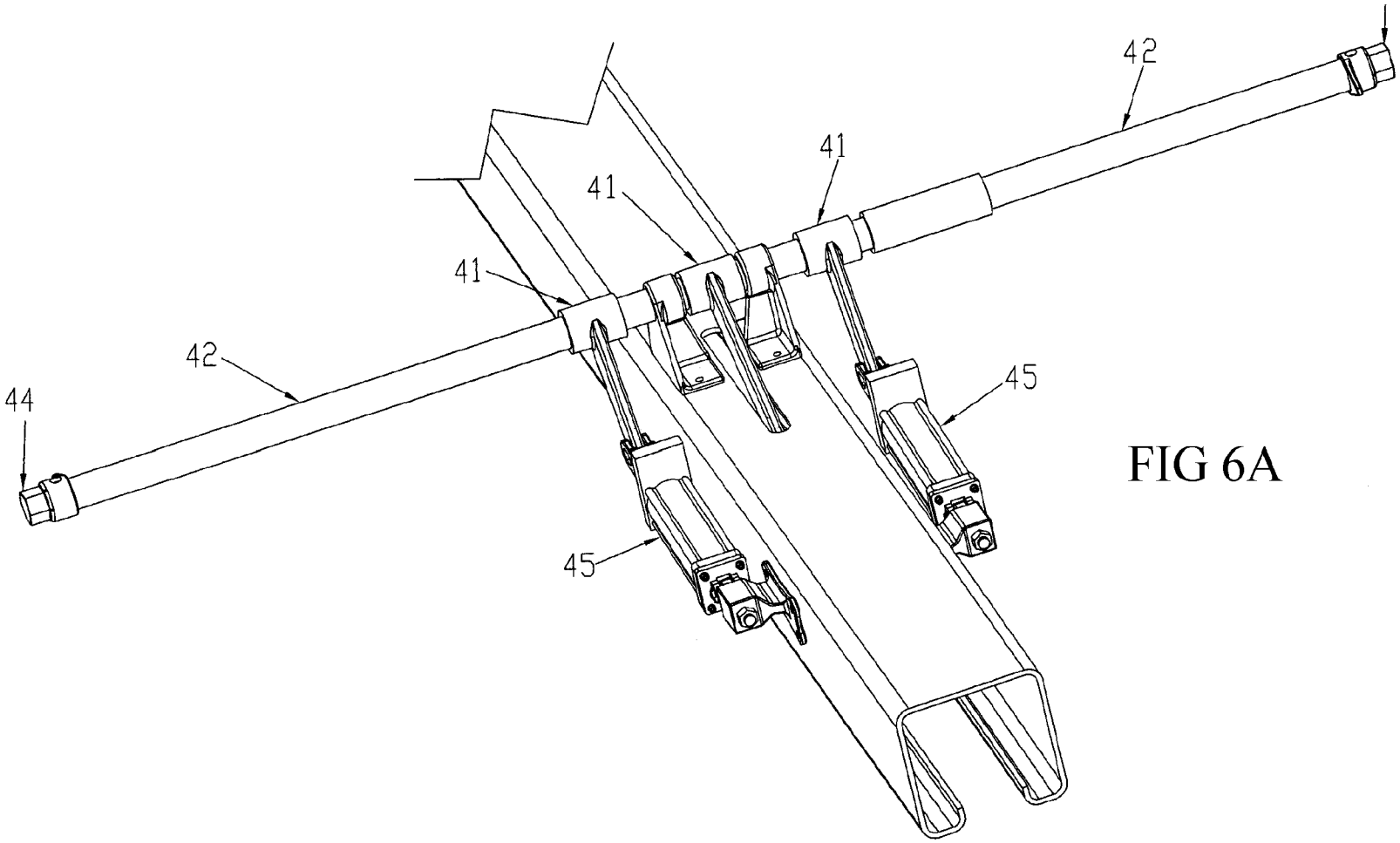
FIG. 6A is a schematic perspective view of a manual override for door operating mechanism of an open top hopper railcar according to one aspect of the present invention.
Figure 6B:
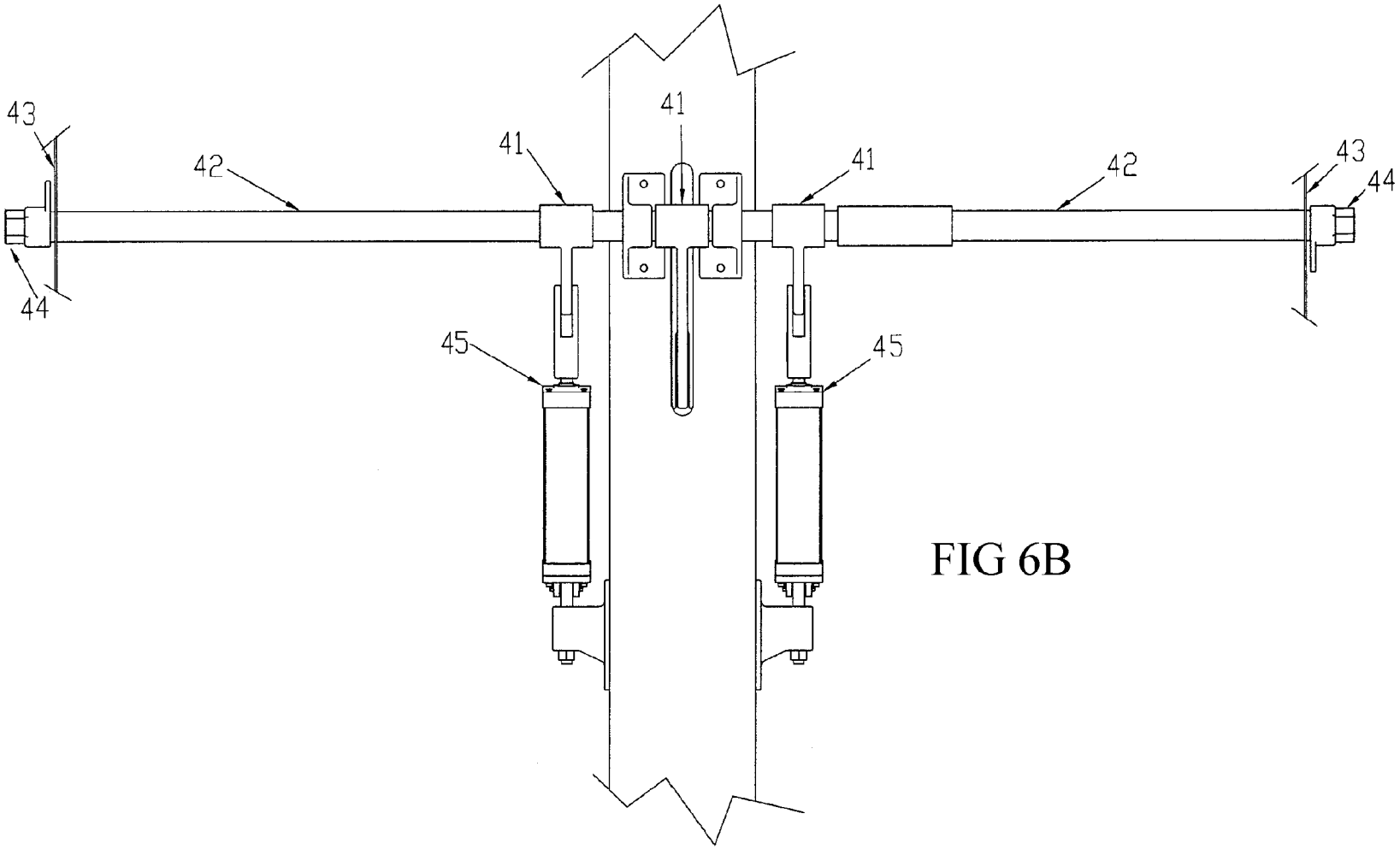
FIG. 6B is a plan view of the manual override system of FIG. 6A.

The present invention provides a mounted manual override as shown in FIG. 6A-6B. The door operating system includes cylinders 45 moving a main door linkage 41 as generally shown. The specifics of the door linkages 1 and the air cylinders 45 can take many forms as known in the art. The emergency override of the present invention utilizes extension rotary shafts 42 extending to both sides 43 of the car 6. The rotary shafts 42 include a coupling 44 for receiving a specialized socket or alternative adapter bar for manually rotating the shafts 42.

In operation, in a system not having sufficient pressure to operate a worker can use a wrench or adapter bar on the coupling 44 and rotate the shafts 42 in a first direction to open the doors and in a second direction to close the doors. The manual operation of hopper doors is, in of itself, known, such that the manual operation will be familiar to workman and not require additional specialized instruction. The present manual override for a pneumatic system is, of course, not known in the art and is the heart of the present door operating mechanism improvements.

The final aspect of the present invention is an integrated universal control or touch plate for door operation control. For hopper cars that use an electrical current to operate one or more of the hopper doors a "touch plate" is mounted on the sidewall 7 to activate the doors collectively or individually. Currently the touch plate of such a hopper car is multiple plates or washers mounted on the side wall 7 with fasteners going through and insulated from the car body. On the inside of the car body where the fastener comes through there are typically exposed wires in such prior art systems that are connected to the insulated fasteners. The wires run to a remote control valve or junction box to operate the doors. The bolt and wires are often exposed and pose hazards in operation, and the prior art systems are labor intensive to implement.

Figure 7A:
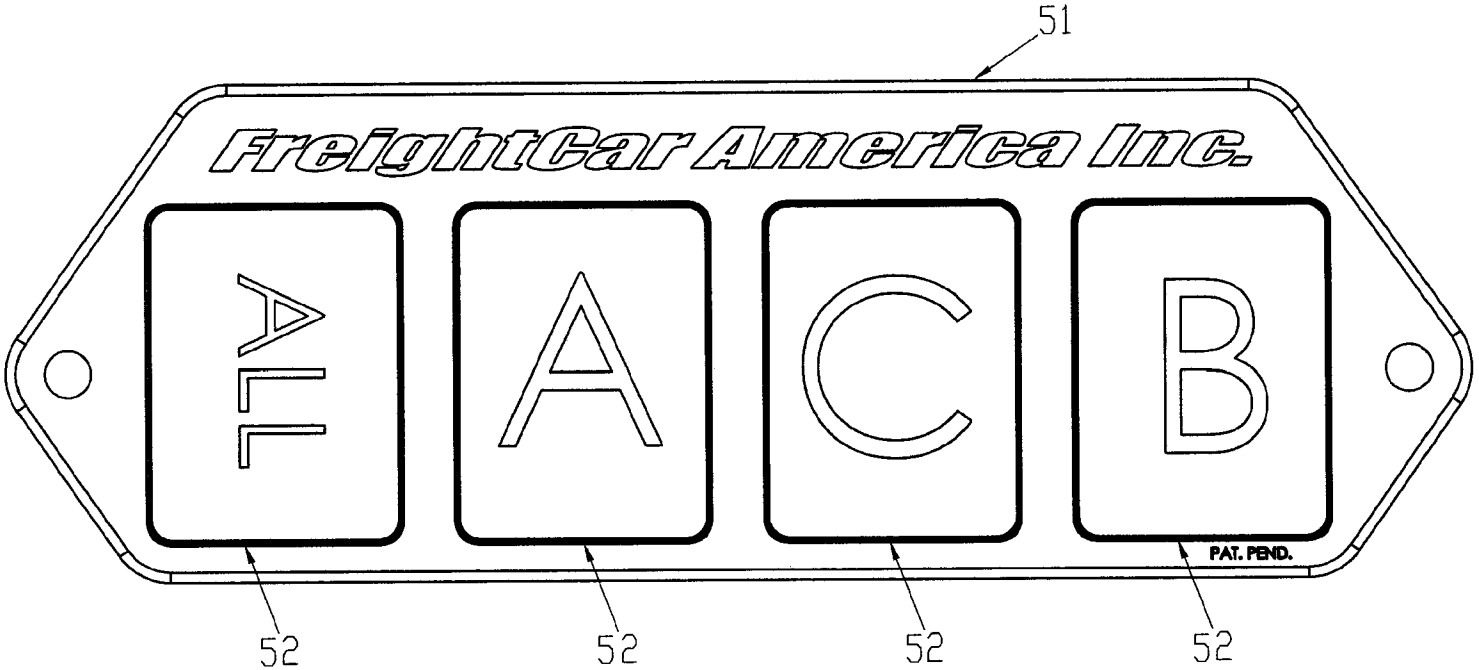
FIG. 7A is a perspective view of an integrated door operating control for the door system for the open top hopper railcar according to one aspect of the present invention.
Figure 7B:
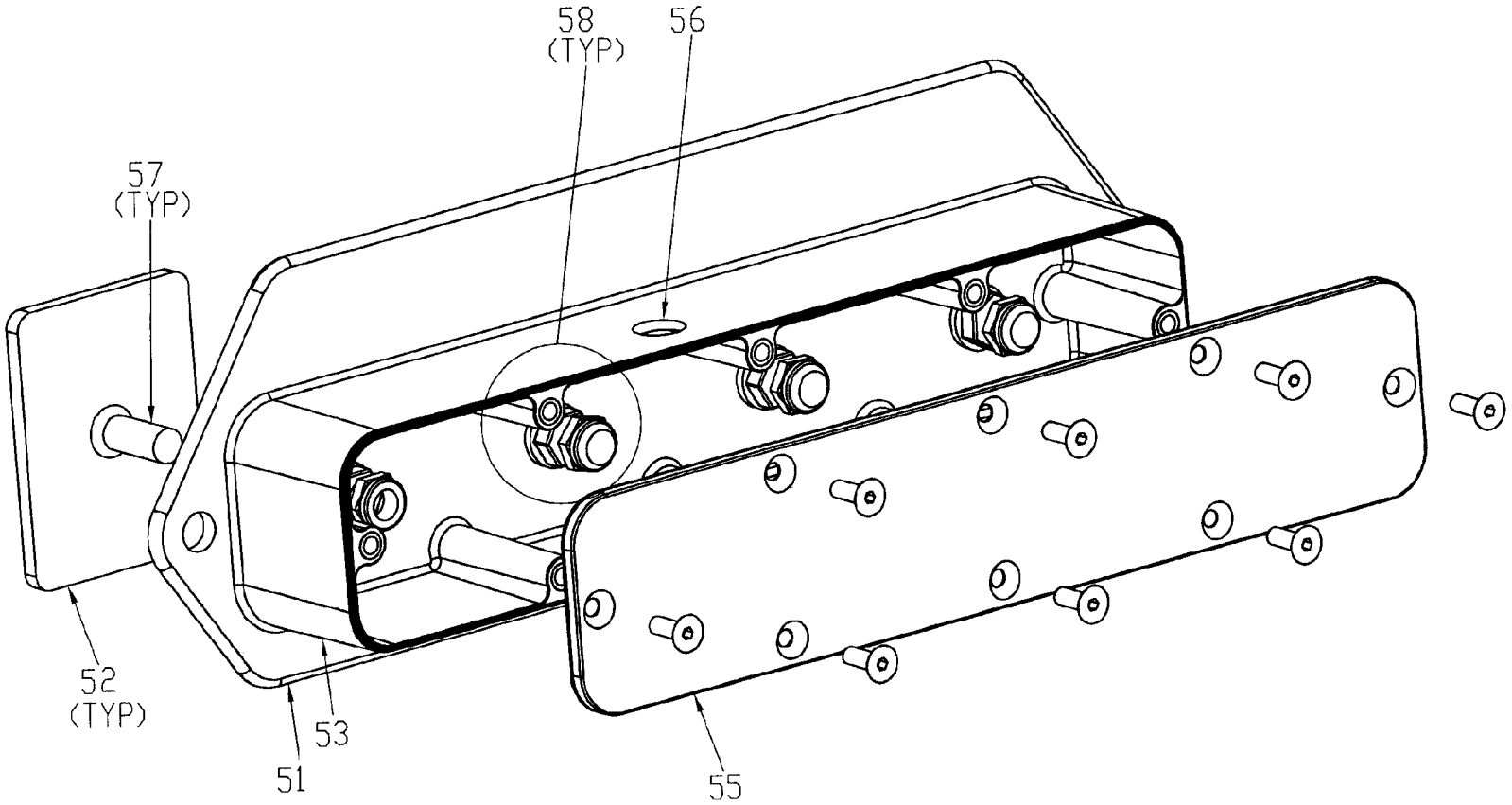
FIG. 7B is an exploded perspective rear view of the integrated door operating control of FIG. 7A.

The present invention provides an integrated control shown in FIGS. 7A and B. The control of the present invention is applicable for all door operation systems using electrical connections to operate the doors. The present control includes a main housing 51 made of a non metallic material, i.e. an insulating material, and will hold the individual touch plates 52. The touch plates 52 may be provides with markings indicative of the associated operation of the specific doors for the car 7. The number and designation of the specific touch plates 52 can change reflective of the desired operation for the specific car. For example, the touch plates 52 as shown are for operating each of three doors individually (as either door A of the A touch plate 52, door B of the B touch plate 52 and door C of the C touch plate 52) or all doors simultaneously (the ALL touch plate 52), and this requires a door operating system that can individually operate the specific doors. Other door combinations are possible, but the applicants believe that the ALL doors or individual doors is the most likely to be useful in most application.

The housing 51 includes an integral juncture box 53 for the respective door actuators (or for all the actuators for the ALL touch plate 52). The housing is mounted on the side wall 7 and insulated the touch plates 52 form the railcar body. The juncture box 53 includes a rear cover 55 with integral gasket to prevent debris and water intrusion. Knock-out portions 56 are provided for adding electrical connectors as needed, allowing wires to run from the box 53 to the appropriate door operating valves.

The touch plates 52 are made of conductive material and include a conductive stud 57 secured with fasters 58. The lead wires are attached to the stud 57 within the housing 51 within the box 53. The universal door control of the invention is easier to install and safer than prior art systems and is easily modified to operate with a wide variety of door designs.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention should be defined by the appended claims and equivalents thereto.

What is claimed is:

1. An open top railcar comprising:

A pair of spaced trucks;

A railcar body supported on the trucks, the body comprising a pair of side structures extending a length on opposed sides of the railcar and a pair of end structures extending a width on opposed ends of the railcar; and a top chord extending the length of the side structures and the width of the end structures, wherein the top chord is a closed section extrusion which includes an inwardly sloped top surface configured to discharge lading toward the interior of the railcar through gravity, wherein the top chord includes a stake attaching web, a lower surface having a width equal to at least a width of the side structure.

2. The railcar of claim 1 further including corner cap members, with each corner cap member including inwardly sloped top surface configured to discharge lading toward the interior of the railcar through gravity.

3. The railcar of claim 1 wherein the railcar is a hopper railcar having a plurality of discharge chutes forming pockets for the body which open to the interior with a plurality of doors operated through a pneumatic door operating system and further including a manual door operating override for each door.

4. The railcar of claim 1 wherein the railcar is a hopper railcar having a plurality of discharge chutes forming pockets for the body which open to the interior with a plurality of doors operated through an automated door operating system and a nonmetallic touch pad housing secured to the side structures and including a plurality of touch plates mounted in the housing configured for operating selective doors and including least one touch plate configured to simultaneously operate a plurality of the doors.

5. The railcar of claim 1 wherein the top chord includes a vertical outer surface extending from the lower surface to the top surface, and an inner surface extending from the top surface to the inside stake attaching web.

6. The railcar of claim 5 wherein the inner surface of the top chord includes an offset whereby the top surface has a greater horizontal width than a horizontal width of the lower surface.

7. The railcar of claim 6 further including corner cap members, with each corner cap member including inwardly sloped top surface configured to discharge lading toward the interior of the railcar through gravity.

8. The railcar of claim 7 wherein each corner cap member includes a vertical extending lip at a distal end of the top surface of the corner cap member.

9. The railcar of claim 1 wherein the railcar is a hopper railcar having a plurality of discharge chutes forming pockets for the body which open to the interior with a plurality of door operated through a pneumatic door operating system and further including a manual door operating override for each door.

10. The railcar of claim 9 further including a pair of rotary shafts, each rotary shaft extending to one side walls with each rotary shaft including a mechanical coupling at a distal end thereof configured to receive a manual rotation member therein, whereby the manual door operating override is accessible from either side of the railcar.

11. The railcar of claim 1 wherein the railcar is a hopper railcar having a plurality of discharge chutes forming pockets for the body which open to the interior with a plurality of doors operated through an automated door operating system and a nonmetallic touch pad housing secured to the side structures and including a plurality of touch plates mounted in the housing configured for operating selective doors and including least one touch plate configured to simultaneously operate all of the doors.

12. The railcar of claim 11 further including an array of aligned touchplate associated with each door for operating each door individually and a further touchplate in the array configured to operate all of the doors simultaneously.

13. A open top hopper railcar comprising:

A pair of spaced trucks;

A railcar body supported on the trucks, the body comprising a pair of side structures on opposed sides of the hopper railcar and a pair of end structures on opposed ends of the hopper railcar, a closed section extrusion top chord extending the length of the side structures and the width of the end structures, and a plurality of discharge chutes forming pockets for the body which open to an interior with a plurality of doors operated through a pneumatic door operating system, and further including a manual door operating override for each door including a pair of rotary shafts, with each rotary shaft extending from the door operating system to one side wall and each rotatory shaft including a mechanical coupling at a distal end thereof configured to receive a manual rotation member therein, whereby the manual door operating override is accessible from either side of the railcar.

14. An open top hopper railcar comprising:

a pair of spaced trucks;

a railcar body supported on the trucks, the body comprising a pair of side structures on opposed sides of the hopper railcar and a pair of end structures on opposed ends of the hopper railcar, a closed section extrusion top chord extending the length of the side structures and the width of the end structures, and a plurality of discharge chutes forming pockets for the body which open to an interior with a plurality of doors operated through a pneumatic door operating system, and further including a manual door operating override for each door including a pair of rotary shafts, with each rotary shaft extending from the door operating system to one side wall and each rotatory shaft including a mechanical coupling at a distal end thereof configured to receive a manual rotation member therein, whereby the manual door operating override is accessible from either side of the rail car; and wherein the top chord includes an inwardly sloped top surface configured to discharge lading toward the interior of the railcar through gravity.

15. The hopper railcar of claim 13 further including a nonmetallic touch pad housing secured to the side structures and including a plurality of touch plates mounted in the housing configured for operating selective doors, wherein one touch plate is associated with each door for operating each door individually and at least one further touch plate configured to operate a plurality of the doors simultaneously.

16. A open top hopper railcar comprising:

A pair of spaced trucks;

railcar body supported on the trucks, the body comprising a pair of side structures on opposed sides of the hopper railcar and a pair of end structures on opposed ends of the hopper railcar, and a plurality of discharge chutes forming pockets for the body which open to an interior with a plurality of doors operated through a pneumatic door operating system, and a nonmetallic touch pad housing secured to the side structures and including a plurality of touch plates mounted in the housing in a continuous array and configured for operating selective doors, wherein one touch plate is associated with each door for operating each door individually and at least one further touch plate configured to operate a plurality of the doors simultaneously.

17. The hopper railcar of claim 16 further including a manual door operating override for each door including a pair of rotary shafts, each rotary shaft extending to one side wall with each rotary shaft including a mechanical coupling at a distal end thereof configured to receive a manual rotation member therein, whereby the manual door operating override is accessible from either side of the railcar.

18. An open top hopper railcar comprising:

a pair of spaced trucks;

a railcar body supported on the trucks, the body comprising a pair of side structures on opposed sides of the hopper railcar and a pair of end structures on opposed ends of the hopper railcar, and a plurality of discharge chutes forming pockets for the body which open to an interior with a plurality of doors operated through a pneumatic door operating system, and a nonmetallic touch pad housing secured to the side structures and including a plurality of touch plates mounted in the housing in a continuous array and configured for operating selective doors, wherein one touch plate is associated with each door for operating each door individually and at least one further touch plate configured to operate a plurality of the doors simultaneously; and wherein, hopper railcar further includes a manual door operating override for each door including a pair of rotary shafts, each rotary shaft extending to one side wall with each rotary shaft including a mechanical coupling at a distal end thereof configured to receive a manual rotation member therein, whereby the manual door operating override is accessible from either side of the railcar, and a top chord extending a length of the side structures and a width of the end structures, wherein the top chord includes an inwardly sloped top surface configured to discharge lading toward the interior of the railcar through gravity.

* * * * *